US012006802B2

(12) United States Patent
Badii et al.

(10) Patent No.: US 12,006,802 B2
(45) Date of Patent: Jun. 11, 2024

(54) TANDEM SUB FOR A SHAPED CHARGE PERFORATION GUN AND RELATED EQUIPMENT

(71) Applicant: REPEAT PRECISION, LLC, Houston, TX (US)

(72) Inventors: Cameron Scott Badii, Houston, TX (US); Ryan Wayne Rowell, Houston, TX (US)

(73) Assignee: REPEAT PRECISION, LLC., Houston, TX (US)

( * ) Notice: Subject to any disclaimer, the term of this patent is extended or adjusted under 35 U.S.C. 154(b) by 102 days.

(21) Appl. No.: 17/901,995

(22) Filed: Sep. 2, 2022

(65) Prior Publication Data

US 2023/0069950 A1 Mar. 9, 2023

Related U.S. Application Data

(60) Provisional application No. 63/260,892, filed on Sep. 3, 2021.

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC ..... E21B 43/117; E21B 43/1185
(Continued)

(56) References Cited

U.S. PATENT DOCUMENTS 3,019,731 A * 2/1962 Edwards ..... E21B 43/117 102/310
8,393,393 B2 * 3/2013 Rodgers ..... E21B 43/1195 175/2

(Continued)

FOREIGN PATENT DOCUMENTS

CA 3037879 7/2022
CA 3120361 10/2023

OTHER PUBLICATIONS

International Search Report for International (PCT) Patent Application No. PCT/US21/52257, dated Feb. 17, 2022, 4 pages.

*Primary Examiner* — Samir Abdosh
(74) *Attorney, Agent, or Firm* — Sheridan Ross P.C.

(57) ABSTRACT

An electrical connection system for providing an electrical signal to a detonator of a perforating gun is provided. The system includes a tandem sub operatively coupled to a gun housing and having a sub body having a bore defined therethrough, a bulkhead assembly having a bulkhead electrical connector securable within the bore, and a printed circuit board assembly. The PCB assembly includes a cartridge having a connection bore adapted to receive the bulkhead electrical connector and define a sliding connection between the cartridge and the bulkhead assembly, and an addressable switch located within the cartridge body and in electrical communication with the bulkhead electrical connector. The detonator is located within the cartridge body and is in electrical communication with the addressable switch. The bore, the bulkhead electrical connector, the cartridge and the detonator are concentrically disposed relative to one another and extend along a common axis.

20 Claims, 13 Drawing Sheets

(58) Field of Classification Search
USPC ..... 89/1.15
See application file for complete search history.

(56) References Cited

U.S. PATENT DOCUMENTS

| | | | | |
|---|---|---|---|---|
| 2012/0250208 | A1* | 10/2012 | Love | E21B 43/1185 166/135 |
| 2014/0138090 | A1* | 5/2014 | Hill | E21B 29/02 166/297 |
| 2016/0075953 | A1* | 3/2016 | Maxwell | H05B 6/108 219/628 |
| 2016/0168961 | A1* | 6/2016 | Parks | E21B 43/1185 102/306 |
| 2017/0199015 | A1* | 7/2017 | Collins | F42B 33/0207 |
| 2019/0368319 | A1* | 12/2019 | Collins | E21B 43/119 |
| 2023/0304384 | A1* | 9/2023 | Rajaram | F42D 5/00 89/1.15 |

* cited by examiner

TANDEM SUB FOR A SHAPED CHARGE PERFORATION GUN AND RELATED EQUIPMENT

CROSS-REFERENCE TO RELATED APPLICATIONS

This application claims priority under 35 U.S.C. § 119(e) of U.S. Provisional Application No. 63/260,892, filed Sep. 3, 2021, entitled "TANDEM SUB FORA SHAPED CHARGE PERFORATION GUN AND RELATED EQUIPMENT," the entirety of which is incorporated herein by reference.

TECHNICAL FIELD

The technical field generally relates to perforating guns for downhole deployment, and more particularly to assemblies and components for operatively connecting a plurality of perforating guns together.

BACKGROUND

Shaped charges are commonly used in perforating guns in order to create perforations extending from a wellbore through the casing and into the surrounding reservoir. Each shaped charge typically has certain components, including a conical metallic liner, the main explosive charge, the explosive primer, and the case that encloses the charge. The detonation of the charges is initiated via a detonator which is energetically coupled via a detonating cord to each of the shaped charges.

When deployed downhole and during downhole operations, the perforation guns are exposed to harsh conditions (e.g., pressures, temperatures, forces from operation of the gun, etc.). Electrical components and the electrical connections therebetween, along with the structural and mechanical connections, are maintained throughout the operational lifecycle of the perforating gun. There are various challenges with respect to the manufacture, assembly, deployment and utilization of perforation guns, and there is a need for a technology that addresses as least some of those challenges.

SUMMARY

According to an aspect, a perforating gun for deployment in a wellbore extending within an underground reservoir is provided. The perforating gun includes a gun housing comprising a central portion, a top sub coupled to a first end of the central portion, and a bottom sub coupled to a second end of the central portion. The perforating gun also has a shaped charge holding assembly installed within the central portion and comprising shaped charge holders arranged in a side-to-side configuration and configured to receive and support respective shaped charges, the shaped charge holding assembly further comprising a mounting unit coupled to an upholemost shaped charge holder and adapted to hold a portion of a detonation cord. The perforating gun further includes a tandem sub operatively coupled between the top sub and the central portion, the tandem sub having a sub body defining a cavity and having a bore defined through a top side and communicating with the cavity; and an electrical connection system. The electrical connection system has a bulkhead assembly located within the tandem sub and comprising a bulkhead securable within the bore of the sub body, and a connection pin secured within the bulkhead and having a first pin head adapted to extend toward and operatively engage an electrical connector provided within the top sub, and a second pin head adapted to extend within the cavity of the sub body. The electrical connection system also includes a printed circuit board (PCB) assembly comprising a cartridge having a cartridge body coupled within the cavity of the sub body, the cartridge body having a connection bore defining a PCB assembly input adapted to receive the second pin head of the bulkhead assembly when positioned within the cavity; an addressable switch installed within the cartridge body, the addressable switch being adapted to be in electrical communication with the second pin head via the PCB assembly input; and a detonator located within the cartridge body and in electrical communication with the addressable switch. The cartridge body has a support member for receiving the detonator and positioning the detonator in a predetermined position, with the detonator being adapted to engage the mounting unit to enable communication with the detonation cord.

According to a possible implementation, the bulkhead is secured within the bore via interference fit.

According to a possible implementation, the cartridge body is slidably connectable to the second pin head of the connection pin.

According to a possible implementation, the PCB assembly further comprises a grounding system defining a plurality of independent ground paths between the PCB assembly and the tandem sub.

According to a possible implementation, the grounding system comprises grounding pins coupled to the printed circuit board and extending radially from the cartridge body, the grounding pins being adapted to engage with radial surfaces of the cavity and define respective independent ground paths.

According to a possible implementation, the grounding pins include pogo pins having a spring-loaded retractable head.

According to a possible implementation, the grounding system comprises a secondary grounding component extending between the cartridge and an axial surface of the cavity, the secondary grounding component defining a secondary independent grounding path.

According to a possible implementation, the secondary grounding component comprises a resilient component adapted to absorb at least some of forces being applied to the PCB assembly from operating the perforating gun.

According to a possible implementation, the secondary grounding component includes a metallic spring.

According to a possible implementation, the cartridge is substantially tubular and has a longitudinal axis defining a centerline, and wherein the connection bore and the bulkhead assembly are adapted to be aligned with the centerline.

According to a possible implementation, the support member is adapted to hold the detonator in alignment with the centerline of the cartridge.

According to a possible implementation, the support member comprises support arms and a rear support, and the detonator has a proximal portion adapted to clip into the support arms and a proximal end adapted to abut against the rear support to position the detonator in the predetermined position, the detonator further having a distal portion extending further than the cartridge to engage the mounting unit.

According to a possible implementation, the PCB assembly further comprises a PCB assembly output adapted to operatively engage the mounting unit and establish an output connection therebetween, wherein the output connection is indicative of the position of the cartridge relative to the mounting unit, which is indicative of the position of the distal portion of the detonator relative to the detonation cord.

According to a possible implementation, the PCB assembly output is defined by frontal pins extending from the printed circuit board and adapted to engage the mounting unit.

According to a possible implementation, the cavity includes an annular groove, and wherein the cartridge includes outwardly biased members adapted to engage the annular groove and at least partially secure the cartridge within the cavity.

According to a possible implementation, the mounting unit is a top mounting unit, and the shaped charge holding assembly further comprises a bottom mounting unit coupled to the downholemost shaped charge holder, the top mounting unit, the shaped charge holders and the bottom mounting unit being in electrical communication to enable a signal therethrough.

According to a possible implementation, the perforating gun further includes a downhole tandem sub coupled between the central portion and the bottom sub, the downhole tandem sub being adapted to house a second electrical connection system adapted to be connected to the bottom mounting unit, wherein the second electrical connection system is adapted to enable electrical connection of a second shaped charge holding assembly to the shaped charge holding assembly.

According to another aspect, a perforating gun for deployment in a wellbore extending within an underground reservoir is provided. The perforating gun includes a gun housing comprising a gun carrier; a shaped charge holding assembly installed within the gun carrier and comprising one or more shaped charge holders configured to receive and support respective shaped charges; a tandem sub operatively coupled to the gun carrier and having a sub body having a bore defined therethrough; and an electrical connection system. The electrical connection system includes a bulkhead assembly located within the tandem sub and comprising a bulkhead electrical connector securable within the bore of the sub body; a printed circuit board (PCB) assembly comprising a cartridge comprising a cartridge body having a connection bore defining a PCB assembly input adapted to receive the bulkhead electrical connector and define a sliding connection between the cartridge and the bulkhead assembly; an addressable switch located within the cartridge body, the addressable switch being adapted to be in electrical communication with the bulkhead electrical connector via the PCB assembly input; and a detonator located within the cartridge body and in electrical communication with the addressable switch, the cartridge body having a support member for holding the detonator in a predetermined position, the shaped charge holding assembly being adapted to engage the detonator to enable ballistic transfer to a detonation cord connected to the shaped charge holding assembly.

According to a possible implementation, the sub body includes a cavity defined therein, the cavity being shaped and sized to house the cartridge, and wherein the bore communicates with the cavity such that the bulkhead electrical connector extend within the cavity for engaging the connection bore of the cartridge body.

According to a possible implementation, the tandem sub and the PCB assembly are coupled to an uphole side of the gun carrier.

According to a possible implementation, the shaped charge holding assembly comprises a mounting unit coupled to an outer shaped charge, the mounting unit having a detonator bore and a chamber in communication with one another, and wherein the detonator is adapted to engage the detonator bore and the detonation cord includes an exposed portion adapted to extend though the chamber to facilitate ballistic transfer from the detonator to the detonation cord.

According to a possible implementation, the outer shaped charge is one of an upholemost shaped charge and a downholemost shaped charge.

According to a possible implementation, the mounting unit comprises a top mounting unit coupled to the upholemost shaped charge and a bottom mounting unit coupled to the downholemost shaped charge.

According to another aspect, an electrical connection system for providing an electrical signal to a detonator of a perforating gun adapted for deployment in a wellbore extending within an underground reservoir is provided. The electrical connection system includes a tandem sub operatively coupled to a gun housing and having a sub body having a bore defined therethrough; a bulkhead assembly having a bulkhead electrical connector securable within the bore of the sub body and adapted to relay an electrical signal therethrough; and a printed circuit board (PCB) assembly comprising a cartridge comprising a cartridge body having a connection bore defining a PCB assembly input adapted to receive the bulkhead electrical connector and define a sliding connection between the cartridge and the bulkhead assembly, the cartridge having a support member for holding and positioning the detonator in a predetermined position to provide ballistic transfer to a detonation cord connected to shaped charges of the perforating gun; an addressable switch located within the cartridge body, the addressable switch being adapted to be in electrical communication with the bulkhead electrical connector via the PCB assembly input to relay the electrical signal to the detonator.

According to another aspect, an electrical connection system for providing an electrical signal to a detonator of a perforating gun adapted for deployment in a wellbore extending within an underground reservoir is provided. The electrical connection system includes a tandem sub operatively coupled to a gun housing and having a sub body having a bore defined therethrough; a bulkhead assembly having a bulkhead electrical connector securable within the bore of the sub body and being adapted to relay an electrical signal therethrough; and a printed circuit board (PCB) assembly comprising a cartridge comprising a cartridge body having a connection bore defining a PCB assembly input adapted to receive the bulkhead electrical connector and define a sliding connection between the cartridge and the bulkhead assembly; an addressable switch located within the cartridge body, the addressable switch being adapted to be in electrical communication with the bulkhead electrical connector via the PCB assembly input; the detonator being located within the cartridge body and in electrical communication with the addressable switch, the cartridge body having a support member for holding the detonator in a predetermined position, where each one of the bore, the bulkhead electrical connector, the cartridge and the detonator being concentrically disposed relative to one another and extend along a common axis.

According to another aspect, a perforating gun for deployment in a wellbore extending within an underground reservoir is provided. The perforating gun includes a gun housing comprising a gun carrier; a shaped charge holding assembly installed within the gun carrier and comprising one or more shaped charge holders configured to receive and support respective shaped charges; a tandem sub operatively coupled to the gun carrier and having a sub body having a bore defined therethrough; an electrical connection system comprising a bulkhead assembly located within the tandem sub and comprising a bulkhead electrical connector securable within the bore of the sub body; a printed circuit board (PCB) assembly comprising a cartridge comprising a cartridge body having a connection bore adapted to receive the bulkhead electrical connector; an addressable switch located within the cartridge body, the addressable switch being adapted to be in electrical communication with the bulkhead electrical connector extending through the connection bore; a detonator located within the cartridge body and in electrical communication with the addressable switch and being adapted to engage the shaped charge holding assembly to enable ballistic transfer to a detonation cord connected to the shaped charge holding assembly; and a biasing element operatively coupled between the tandem sub and the cartridge and being adapted to bias the cartridge toward the shaped charge holding assembly to maintain engagement of the detonator with the shaped charge holding assembly.

According to a possible implementation, the PCB assembly includes an output electrical connector adapted to engage and be electrically connected to the shaped charge holding assembly, and wherein the biasing element is adapted to bias the cartridge toward the shaped charge holding assembly to maintain the electrical connection between the PCB assembly and the shaped charge holding assembly.

DETAILED DESCRIPTION

Figure 1:
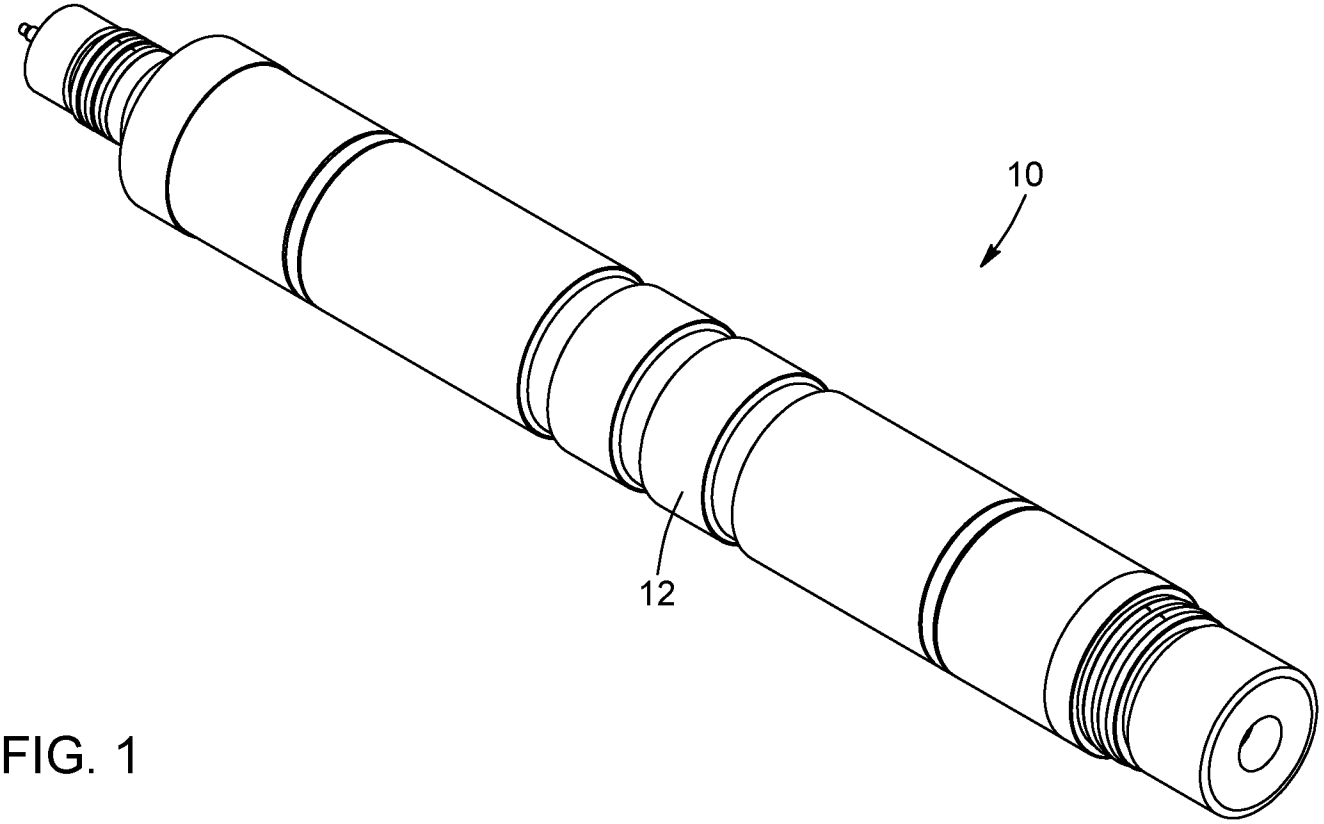
FIG. 1 is a perspective view of a perforating gun connectable along a workstring deployed downhole in a wellbore, according to an embodiment.

As will be explained below in relation to various implementations, the present disclosure describes apparatuses, systems and methods for the connection of equipment disposed downhole in a wellbore.

In some implementations, the present disclosure describes methods and systems for operatively connecting structural and electrical components within a perforating gun and/or between perforating guns installed along a workstring deployed downhole in a wellbore. The perforating gun has a gun housing which includes a carrier adapted to house a perforating gun subassembly provided with shaped charges and a shaped charge holding assembly. The gun housing further includes a top sub and a bottom sub which can be coupled to either end of the gun assembly. The components of the perforating gun are adapted to provide either pressure isolation between two or more elements, electric continuity (e.g., electric connection) between two or more elements, or both.

In some implementations, the perforating gun includes one or more tandem subs coupled between the top sub and the carrier and/or between the bottom sub and the carrier. The tandem sub can be adapted to house at least some of the components which define structural and electrical connections to enable operatively connecting shaped charge holding assemblies together and improve modularity of the overall perforating gun. For example, the tandem sub can have a sub body defining a cavity for housing an electrical connection system configured to be connected to connectors provided within the top sub on a first side, and to the shaped charge holding assembly on a second side. The shaped charge holding assembly is adapted to enable transmission of an electrical signal through the assembly, which can be connected to another electrical connection system provided within a second tandem sub. It is thus noted that another shaped charge holding assembly can be coupled to the second tandem sub to operatively engage the second electrical connection system.

The tandem sub and the electrical connection system housed within it are also configured to facilitate alignment of various components of the perforating gun, along with providing robust structural and electrical connections between the various components of the perforating gun. The electrical connection system can include a bulkhead assembly securable through a bore defined through the body of the tandem sub, and which communicates with the cavity. The bulkhead assembly is secured to the tandem sub (e.g., within the bore) and includes a pair of male pins extending at opposite ends thereof. The bulkhead assembly can be slid into the bore and secured therein (e.g., via interference fit) and/or with the use of retaining rings. The bulkhead assembly connection provides a secure and solid (e.g., non-moving) component such that the male pins are positioned in predetermined locations. The male pins being in a predetermined position can facilitate engagement with the connectors of the top sub on a first side and with a printed circuit board (PCB) assembly on a second side. In other implementations, the bulkhead assembly can be connected between a gun assembly on a first side, and a secondary PCB assembly.

The PCB assembly includes a cartridge for holding an addressable switch and a detonator. The detonator is provided within the cartridge in a manner such that the detonator is retained on a centerline of the cartridge and in a predetermined position. Therefore, the detonator can be in a known location relative to a detonation cord to provide greater control of the detonation operation sequence. The cartridge includes a connection bore slidably engageable with one of the male pins of the bulkhead assembly, and further includes a grounding system defining a plurality of independent grounding paths to ensure electrical communication with the switch and the detonator. The cartridge can also serve as protection for the electrical components of the PCB assembly from shocks (e.g., shockwaves) created from operating the perforating gun (e.g., detonating the detonation cord).

Figure 2:
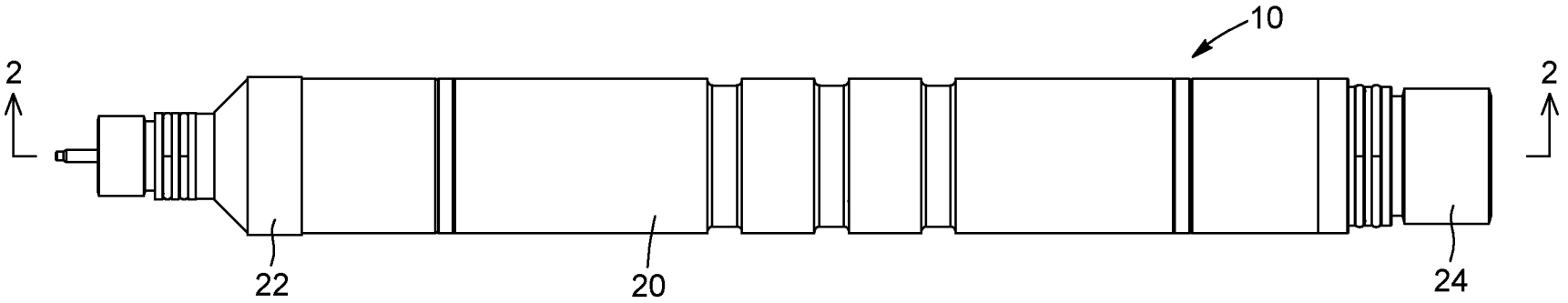
FIG. 2 is a side view of the perforating gun shown in FIG. 1.
Figure 3:
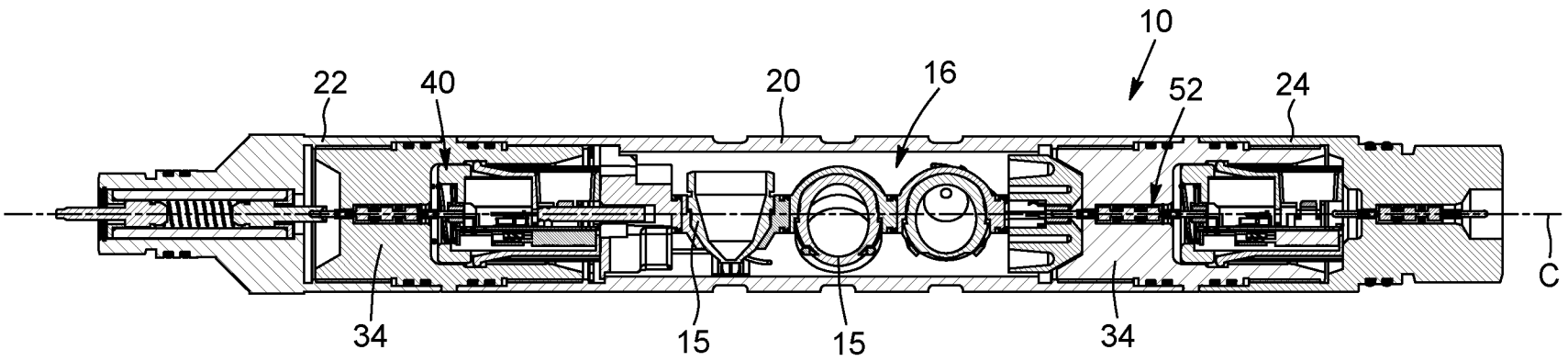
FIG. 3 is a sectional view of the perforating gun shown in FIG. 2, showing a perforating gun subassembly housed within a housing of the perforating gun, according to an embodiment.

With reference to FIGS. 1 to 3, an implementation of a perforating gun 10 is shown. The perforating gun 10 includes a carrier, or housing 12, having a tubular form and which is shaped and adapted to house a perforating gun subassembly provided with shaped charges 15 and a shaped charge holding assembly 16. The housing 12 can include a central portion 20, within which the shaped charges 15 are provided, a top sub 22 coupled to a first end of the central portion 20, and a bottom sub 24 coupled to a second opposite end of the central portion 20. As will be described further below, adjacent perforating guns 10 can be operatively coupled to one another via a connection between the top and bottom subs. More specifically, two or more perforating guns 10 can be operatively coupled to one another, with a topmost perforating gun 10 engaging the top sub 22 (directly or indirectly) and the bottommost perforating gun engaging the bottom sub 24 (directly or indirectly).

In some implementations, the top and bottom subs 22, 24 can be configured to enable crossover to other downhole tools, such that tools having different threads and/or different connection methods can be connected to one another (e.g., along a downhole workstring).

Figure 4:
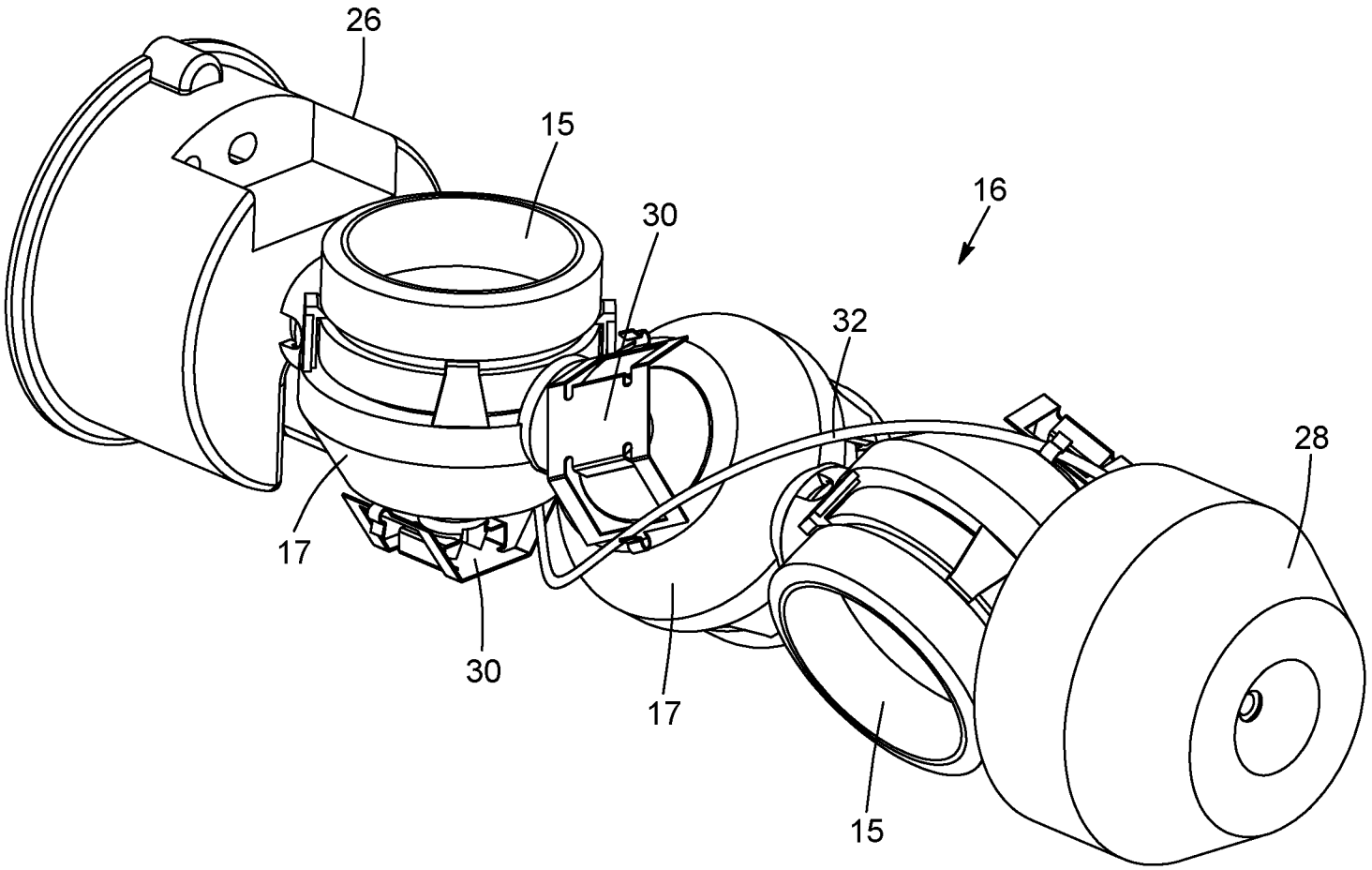
FIG. 4 is a perspective view of a shaped charge holding assembly adapted to hold three (3) shaped charges, according to a possible embodiment.
Figure 5:
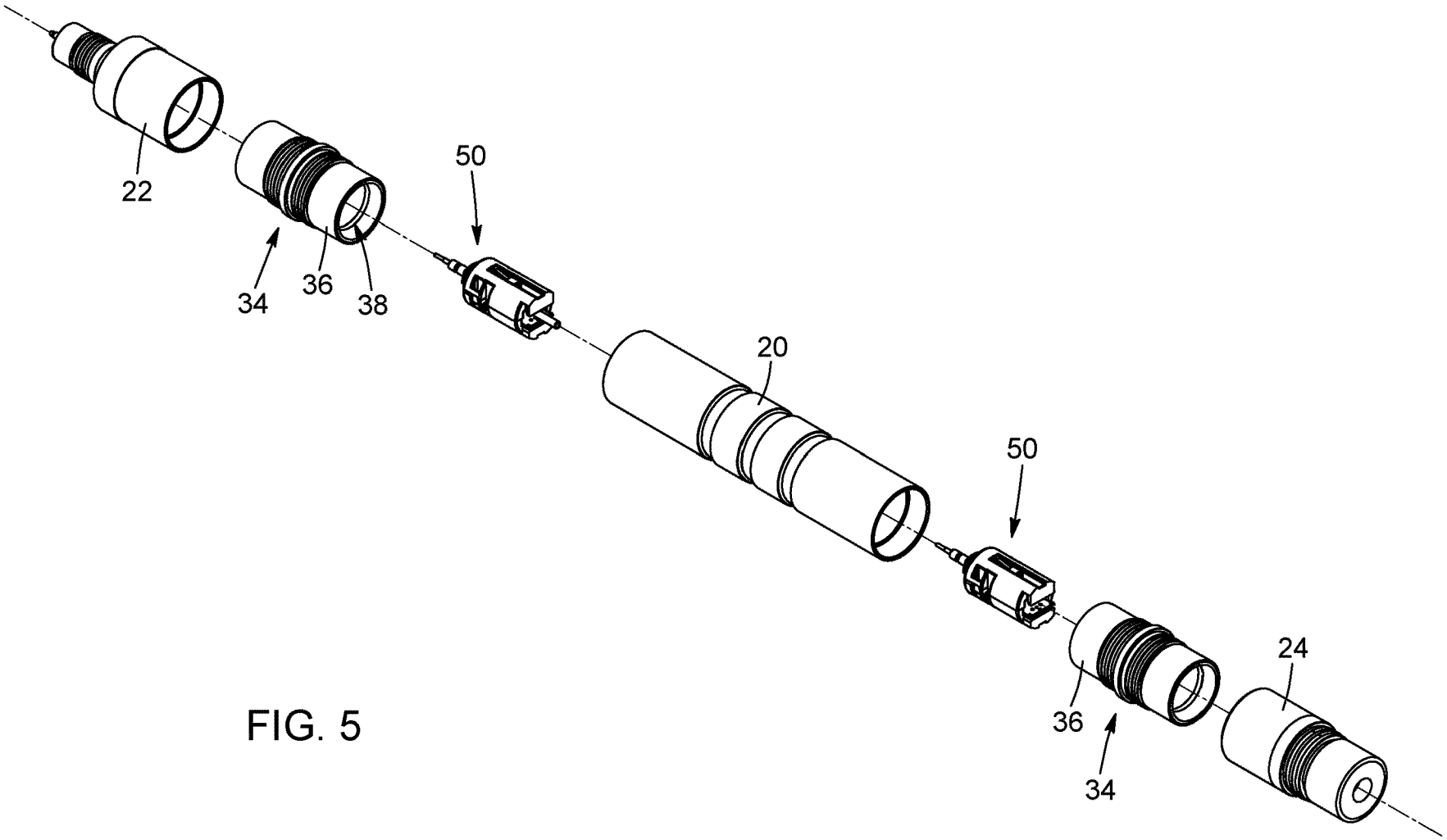
FIG. 5 is a perspective exploded view of the perforating gun shown in FIG. 1, showing an electrical connection system coupled between components of the perforating gun, according to an embodiment.
Figure 6:
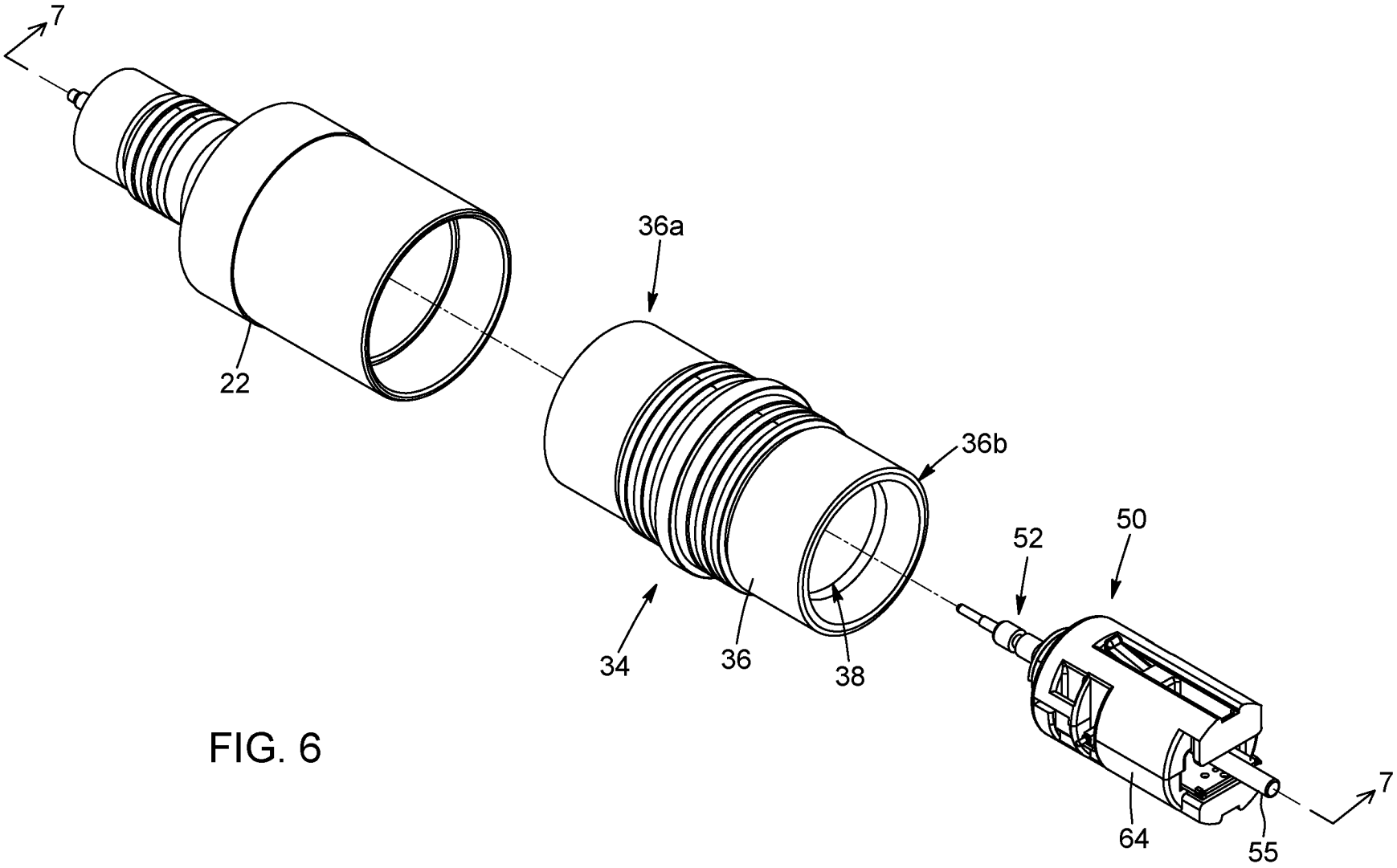
FIG. 6 is an exploded view of a top end of the perforating gun shown in FIG. 5, showing the electrical connection system coupled to a tandem sub which is in turn connectable to a top sub, according to an embodiment.

Referring to FIG. 4, in addition to FIG. 3, the shaped charge holding assembly 16 can include opposing mounting units (including a top mounting unit 26 and a bottom mounting unit 28), and an alignment system. The shaped charge holding assembly 16 can include one or more shaped charge holders 17 arranged in series, and which can be independently and infinitely rotatable with respect to each other. The shaped charge holding assembly 16 can be made up of the holders 17 which are directly coupled together, or can include holders 17 that are interconnected via other components that enable certain functions such as rotation between the holders, reinforcement, and so on.

The shaped charge holding assembly 16 can cooperate with an alignment system which can include multiple alignment connectors 30 that are operatively connectable with respect to respective charges 15, and an alignment member 32 (e.g., alignment rod) that is securable to the top mounting unit 26 and to each of the alignment connectors 30 along its length. The alignment connectors 30 can take the form of retaining clips that attach to the shaped charges 15, as illustrated, or as connectors that are part of or attached to the holders 17. The alignment rod 32 has a configuration, such as a helical configuration, that extends around and along the series of holders 17 such that the alignment rod defines connection points that are axially spaced-apart from each other and positioned at radial locations for respectively coupling with the alignment connectors 30 for orientation of the shaped charges 15 at a predetermined phasing. For example, the helical part of the alignment rod can have a pitch that is coordinated with the spacing between the connectors 30 such that the rod intersects with the axial positions of the connectors 30 at predetermined radial locations to provide a desired phasing of the shaped charges 15. Depending on the pitch of the helical segment of the alignment rod and the spacing between the connectors 30, various phasing configurations can be achieved. Exemplary implementations of the perforating gun 10 provided with the shaped charge holding assembly 16 are described in Applicant's co-pending international patent application No. PCT/US2021/052257 (published as WO 2022/067212), which is incorporated herein by reference in its entirety. However, it is appreciated that other configurations of the shaped charge holder assembly can be used, and other gun designs can be used with the tandem sub described herein.

It should be noted that the perforating gun 10 can be operated as a top-fired perforating gun, where the shaped charges are detonated in sequence from top to bottom (e.g., from an upholemost shaped charge to a downholemost shaped charge). Alternatively, the perforating gun 10 can be operated as a bottom-fired perforating gun where the shaped charges are detonated in sequence from bottom to top. In some implementations, the perforating gun includes a plurality of shaped charge holding assemblies which can be respectively operable in a top-fire or a bottom-fire configuration. In other words, each shaped charge holding assembly can be fired using the same operation sequence (e.g., top-fired or bottom-fired), or fired using varying operation sequences (e.g., a first gun is top-fired and a second gun is bottom-fired, etc.).

Referring to FIGS. 5 to 8, the perforating gun 10 can further include one or more tandem subs 34 provided between other adjacent components of the housing 12, and being configured to facilitate alignment and connection between these components and the elements provided therein. For example, in this implementation, the perforating gun 10 includes a tandem sub 34 coupled between the top sub 22 and the central portion 20. The tandem sub 34 can be connected to the housing 12 via any suitable method, such as via interference fit, with fasteners, threaded connectors, via a slot and key connection or any combination thereof. It is noted that the components of the perforating guns 10 include the appropriate seal(s) provided between any given connected components.

Figure 7:
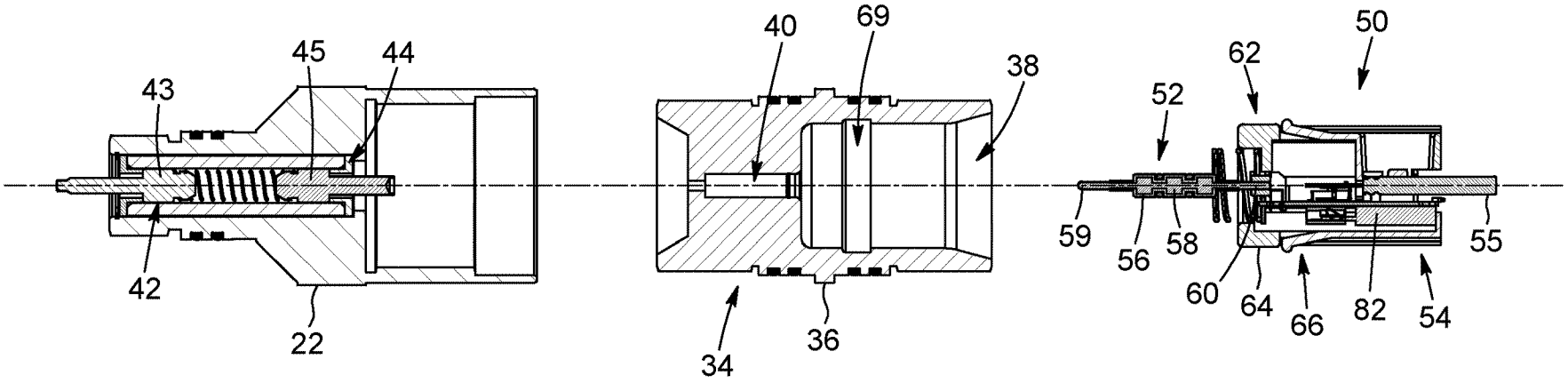
FIG. 7 is a sectional exploded side view of the components shown in FIG. 6, showing a cartridge connectable within a recess of the tandem sub, according to an embodiment.
Figure 8:
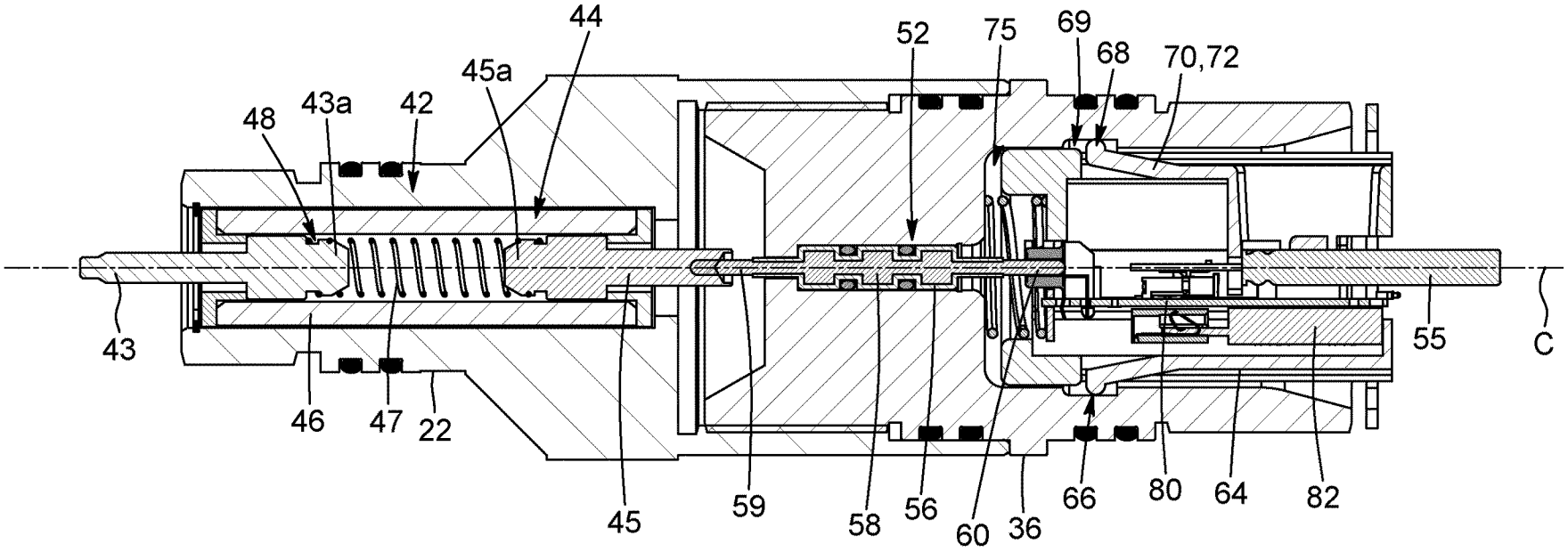
FIG. 8 is a sectional side view of the components shown in FIG. 7 connected to one another, showing a bulkhead assembly of the electrical connection system coupled to a plunger assembly of the top sub, according to an embodiment.

In this implementation, the tandem sub 34 can be adapted to house at least a portion of an electrical connection system 50 operatively connected to the perforating gun subassembly for operation thereof, for example, for enabling detonation of the shaped charges. In some implementations, the tandem sub 34 includes a sub body 36 defining a cavity 38 therein opening on a downhole side **36*b* of the sub body 36. As will be described further below, the cavity 38 of the sub body can be shaped and sized to house at least a portion of the electrical connection system 50. As seen in FIGS. 7 and 8, the tandem sub 34 has a bore 40 defined therethrough to establish communication between an uphole side 36***a* of the sub body and the cavity 38.

In this implementation, the top sub 22 includes an electrical connector, such as a plunger assembly 42, which is installed within a top sub bore 44 and configured to enable electrical communication between components operatively connected to the plunger assembly 42. More specifically, the plunger assembly 42 can include a first plunger 43 extending further than the top sub bore 44 on a first side thereof, and a second plunger 45 extending further than the top sub bore 44 on a second side thereof. It is appreciated that the plungers 43, 45 extend further than the top sub bore 44 in order to facilitate engagement with adjacent components connected to the top sub 22. As seen in FIG. 8, the plunger assembly 42 includes a plunger housing 46 secured within the top sub bore 44 for holding the plungers, and further includes a resilient coupling element 47 (e.g., a spring) operatively coupled between the plungers to enable movement thereof along the housing 46. It is thus noted that the plunger assembly 42 includes dual internal spring-loaded plungers. In this implementation, the spring is forced to flex outward and holds the plungers captive by radial compression, thereby preventing wellbore materials, fluid, gunk, water, debris and/or insulators from ruining the electrical integrity of the plunger assembly.

Each plunger 43, 45 can have a head portion 43*a*, 45*a* and a body portion 43*b*, 45*b*, where the resilient coupling element 47 is connected to the head portions, and the body portions are slidably mounted within the housing 46. In this implementation, the head portions 43*a*, 45*a* include a slanted surface leading to a grooved section 48, or "catch". The resilient coupling element 47 can thus be threaded on, or pushed against, the head portions to slide over the head and have a segment thereof be positioned within the grooved section 48, thereby securing the resilient coupling element 47 to the plunger. The above-described configuration of the plunger assembly 42 is meant to be exemplary only, and it is appreciated that other configurations and/or components can be used to define an electrical connection through the top sub of a perforating gun.

The electrical connection system 50 can be adapted to be operatively coupled to the plunger assembly 42 to receive an electrical signal (e.g., from operators at surface) and relay the electrical signal to the shaped charge holding assembly. In some implementations, the tandem sub 34 and the electrical connection system 50 can be adapted to facilitate gun-to-gun connections and can enhance modularity of the perforating guns 10 by providing structural and electrical connections within any given perforating gun 10, and between adjacent shaped charge holding assemblies 16.

Figure 9:
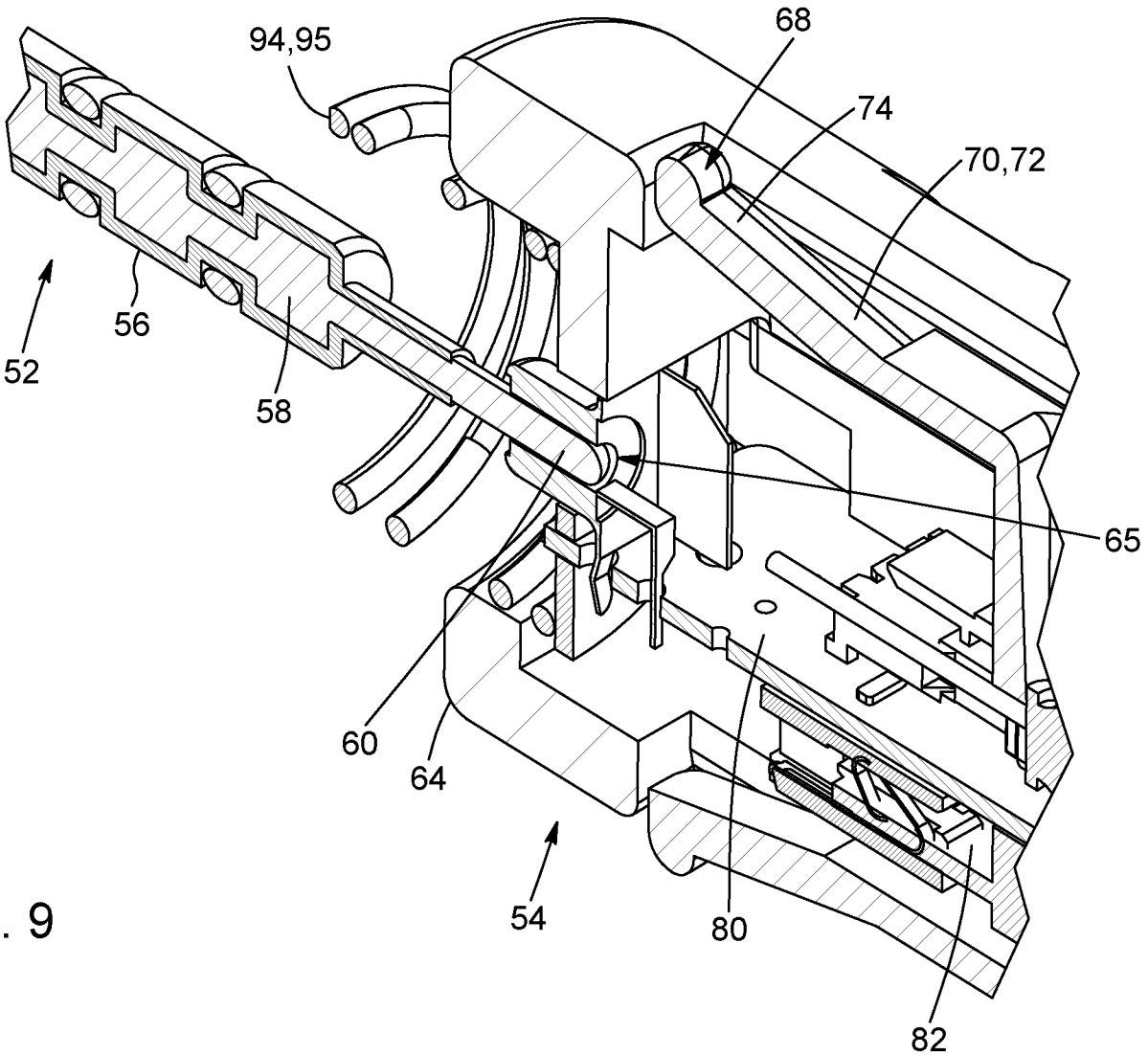
FIG. 9 is a sectional perspective view of a portion of the electrical connection system shown in FIG. 8, showing the bulkhead assembly coupled to a PCB assembly within a body of the cartridge, according to an embodiment.

Still with reference to FIGS. 5 to 8, the electrical connection system 50 can be at least partially housed within the tandem sub 34, and more particularly, within the cavity 38 and/or through the bore 40 of the sub body 36. In an exemplary implementation, the electrical connection system 50 can be housed within the cavity 38 of the tandem sub 34, with the tandem sub being adapted to be connected to the central portion 20 of the housing which houses the gun assembly (e.g., the shaped charge holding assembly and mounting units). In this implementation, the electrical connection system 50 includes a bulkhead assembly 52 adapted to be electrically connected to the plunger assembly 42 (as seen in FIG. 8), and a printed circuit board (PCB) assembly 54 in electrical communication with the bulkhead assembly 52 (as seen in FIG. 9) for receiving the electrical signal therefrom. The bulkhead assembly 52 can include a bulkhead 56, or bulkhead body, shaped and adapted to engage the bore 40. The bulkhead 56 can be connected to the sub body 36 (e.g., within the bore 40) via interference fit, although it is appreciated that other methods of connection are possible and may be used. The interference fit defines a connection adapted to generally prevent movement of the bulkhead 56 within the bore 40, which can otherwise cause connection issues between the plunger assembly 42 and/or the PCB assembly 54.

The bulkhead assembly 52 further includes a connection pin 58 extending through the bulkhead 56. The connection pin 58 has a first pin head 59 adapted to extend toward and operatively engage the plunger assembly 42 (e.g., the second plunger 44) provided within the top sub, and a second pin head 60 adapted to extend within the cavity 38 of the sub body for engagement with the PCB assembly 54. As seen in FIGS. 7 and 8, the connection pin 58 can be a relatively solid one-piece unit provided within the bulkhead 56, with the pin heads 59, 60 extending further than the bulkhead and out of the bore 40 on opposite sides thereof. It should be noted that the bulkhead 56 can be made of insulating material adapted to protect the connection pin 58 secured therein. The bulkhead can be further provided with seals adapted to extend between the bulkhead and the inner surfaces of the bore 40 to define a substantially sealed connection and provide pressure isolation between the components of the perforating gun.

In some implementations, the PCB assembly 54 includes a cartridge 62 having a cartridge body 64 adapted to be connected to the sub body 36 within the cavity 38. The cartridge body 64 can be adapted to house electrical components (e.g., a printed circuit board, among others) and a detonator 55 configured to cooperate with the shaped charge holding assembly to operate the perforating gun (e.g., to detonate the shaped charges). As will be described below, the shaped charge holding assembly is adapted to hold and position a detonation cord relative to each shaped charge. The detonation cord is secured at one end thereof within the top mounting unit, where the detonator is adapted to provide the required energy to an exposed portion of the detonation cord to energize the cord and fire the shaped charges. The detonator receives the electrical signal from the electronic components within the cartridge body 64, which is adapted to relay the electrical signal received from the bulkhead assembly.

As seen in FIGS. 7 to 9, the cartridge 62 can be provided with a coupling assembly 66 configured to engage the tandem sub in a manner securing the cartridge body 64 within the cavity 38. It is appreciated that securing the cartridge 62 within the cavity 38 positions the electrical components of the PCB assembly in a predetermined position relative to the shaped charge holding assembly (e.g., relative to the detonation cord) and/or relative to the bulkhead assembly. In this implementation, the coupling assembly 66 includes one or more protrusions 68 shaped and sized to engage the inner surface of the sub body 36. The inner surface of the sub body 36 can include one or more recesses 69 for receiving respective protrusions 68 and holding the cartridge 62 within the cavity 38. In some implementations, the recess 69 extends circumferentially around the surface of the cavity 38 such that the protrusions 68 can engage the recess at any point therealong (e.g., 360 degrees around the inner surface of the cavity 38).

The coupling assembly 66 can further include a resilient element 70 adapted to bias the protrusions 68 outwardly to facilitate engagement with the recess 69. In this implementation, the resilient element 70 can include a resilient arm 72 extending outwardly from the cartridge body 64 and having a free distal end 74, where the protrusion 68 is positioned proximate the free distal end 74. It is noted that the resilient arm 72 is adapted to exert an outward radial force to bias the protrusion outwardly and within the recess. It should therefore be understood that the resilient arm 72 is adapted to pivot (e.g., about its base) to enable the free end 74 to move radially relative to the inner surface of the cavity 38. It is thus appreciated that the cartridge 62 can be connected to the tandem sub by sliding the cartridge body 64 within the cavity 38 until the protrusions 68 engage the recess 69. As seen in FIGS. 7 to 9, the coupling assembly 66 can include two resilient arms 72, and therefore two protrusions 68 adapted to engage the recess on opposite sides of the cartridge. However, it is appreciated that other configurations are possible, such as having additional resilient arms and/or protrusions, either aligned with one another to engage the same recess, or offset axially along the cartridge body to engage additional recesses defined within the cavity, for example.

As mentioned, the PCB assembly is adapted to be operatively connected to the bulkhead assembly, and can be adapted to be electrically connected to the second pin head 60. In this implementation, the cartridge body 64 includes a connection bore 65 defining a PCB assembly input adapted to receive the second pin head 60 therein when positioning the cartridge 62 within the cavity. The connection bore 65 and the second pin head 60 are slidably connected together, whereas the second pin head 60 slides into the connection bore 65 when the cartridge 62 is positioned within the cavity 38 (e.g., similar to an RCA-type connection). As such, it is appreciated that the contact surface between the connection bore 65 and the second pin head 60 can correspond to the lateral surface of the pin head along which the sliding connection is defined. In other words, the sliding connection is defined by a radial connection of the second pin head 60 within the connection bore 65, instead of an end-to-end connection It is noted that, by coupling the cartridge body 64 within the cavity via the engagement of the recess with the protrusions, combined with the generally static bulkhead assembly 52 secured within the bore 40, the connection of the second pin head 60 with the connection bore 65 is robust (e.g., adapted to prevent disconnection). In other words, the cartridge can be in a predetermined position (e.g., when the protrusions engage the recess) and the position of the bulkhead assembly is in a similarly predetermined position (e.g., when secured in the bore) such that the position of the second pin head 60 relative to the connection bore 65 can be guaranteed along the sliding connection.

In this implementation, the recess 69 is larger than the protrusions 68 to enable movement of the cartridge 62 within the cavity 38 (e.g., axially along the cavity). As seen in FIG. 8, the cartridge body 64 defines a play 75 (e.g., a void or generally empty space enabling movement therein) with the axial surface of the cavity 38, which can substantially correspond to the amount of play between the protrusion and the uphole portion of the larger recess. The size of the protrusions 68, the recess 69 and the play 75 are adapted to enable movement of the cartridge during operation of the perforating gun, e.g., during detonation of the shaped charges. As such, the electronic components are at least partially protected from shocks, such as shocks created from operating the perforating gun and/or other energetically or hydraulically actuated tools. It should be noted that, during movement of the cartridge body, the connection bore 65 is adapted to slide along the second pin head 60, thereby keeping the electrical connection established between the bulkhead assembly and the PCB assembly. As will be described below, the PCB assembly can be provided with a resilient component, such as a spring, adapted to bias the cartridge in a predetermined position, absorb at least some of the shock (e.g., from the detonation) and/or revert the cartridge body 64 back into the predetermined position following movement thereof within the cavity.

In some implementations, the PCB assembly further includes a printed circuit board (PCB) 80 housed within the cartridge 62. The PCB 80 has an addressable switch 82 installed thereon, or integrated therewith, which is adapted to be in electrical communication with the second pin head 60 via the PCB assembly input (e.g., via the connection of the second pin head within the connection bore). In turn, the detonator 55 is electrically connected to the PCB assembly, and more specifically to the addressable switch 82, thereby enabling an electric signal to be sent to the detonator. As such, an electric signal can be sent, for instance, from an operator or a control box (e.g., enabling remote operations) at surface, to the addressable switch 82 to electrically operate the detonator 55 to fire the perforating gun. With the detonator 55 being held in place within the cartridge body 64, and with the cartridge defining a robust electrical connection with the bulkhead assembly, it is appreciated that the electrical connection enabling the electric signal to the detonator is similarly robust.

Figure 10:
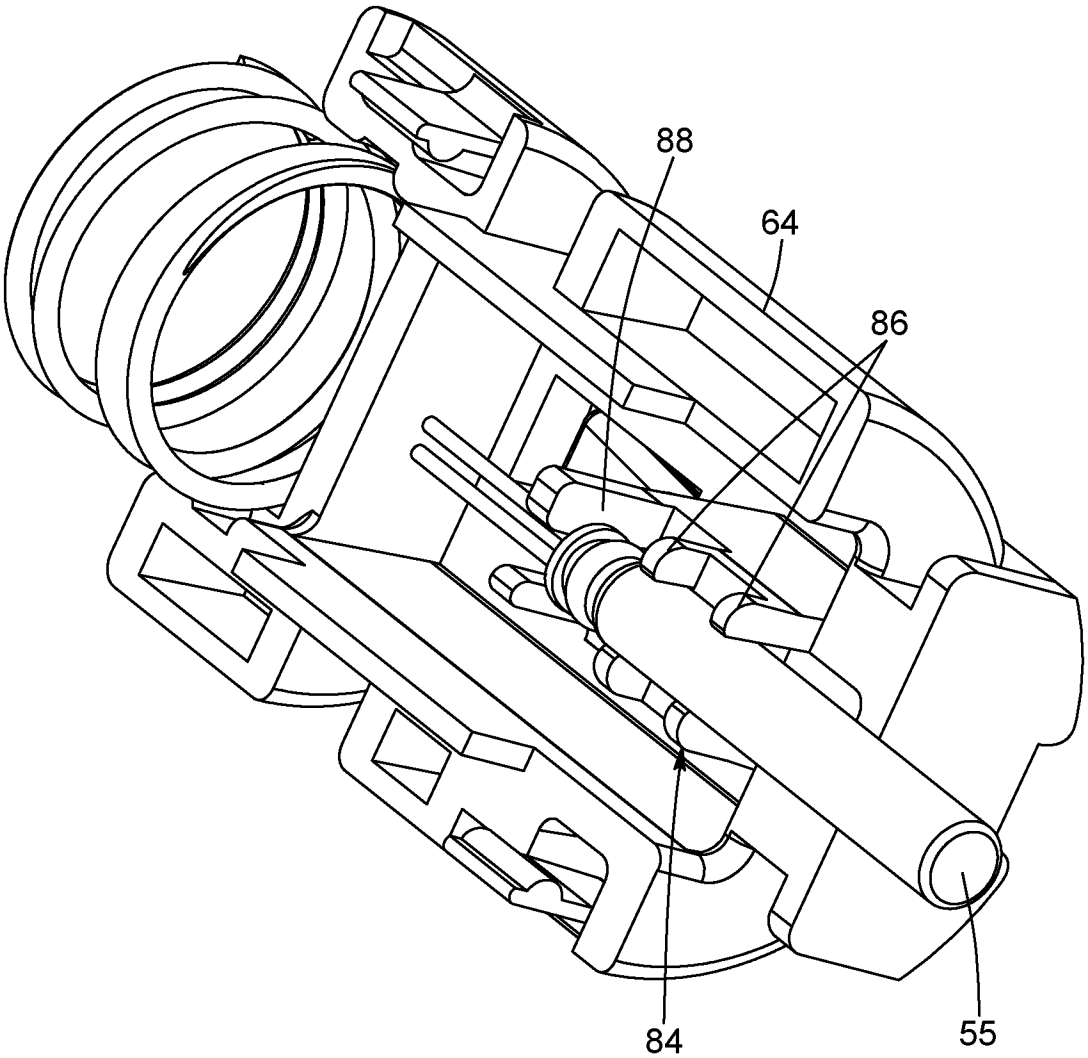
FIG. 10 is a sectional perspective view of portions of the cartridge body, showing a detonator installed therein, according to an embodiment.
Figure 11:
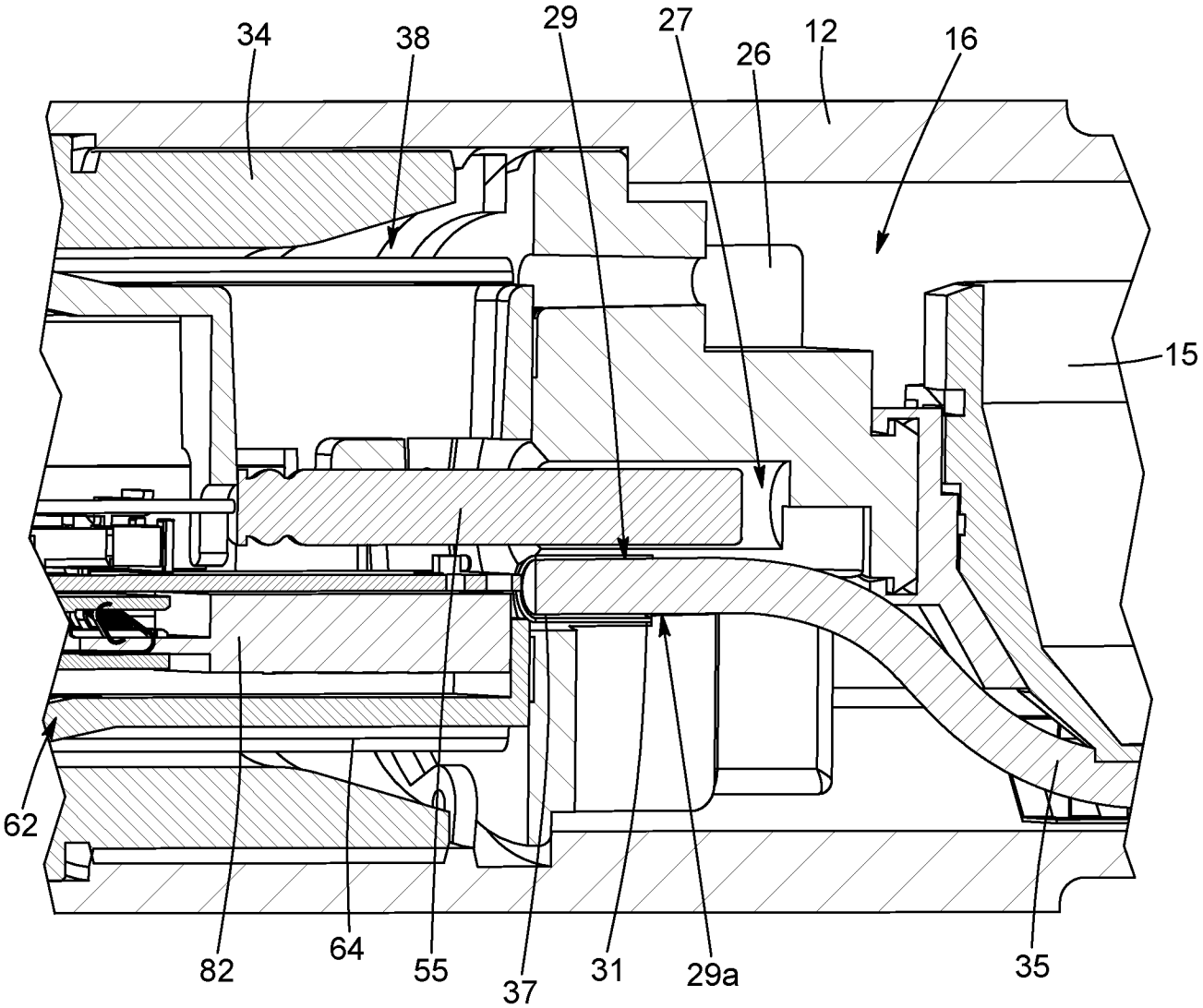
FIG. 11 is a sectional side view of a portion of the cartridge and the perforating gun subassembly, showing the detonator extending within the perforating gun subassembly with a detonation cord proximate the detonator, according to a possible embodiment.

Now referring to FIGS. 8, 10 and 11, the detonator 55 can be removably coupled within the cartridge body 64 and in electrical communication with the addressable switch 82. In some implementations, the cartridge body 64 includes a support member (or support element) 84 shaped and adapted for receiving the detonator 55 and positioning the detonator 55 in a predetermined position within the cartridge body 64. As seen in FIG. 11, the tandem sub 34, and the cartridge 62 held within, are adapted to be positioned adjacent the top mounting unit 26 of the shaped charge holding assembly 16. In addition, the top mounting unit 26 includes a detonator bore 27 configured to receive a portion of the detonator 55, which extends further than the cartridge body 64 (as seen in FIGS. 7, 8, 10 and 11). More particularly, the detonator 55 has a proximal end adapted to abut a portion of the support member 84 within the cartridge body 64, and a distal end extending outwardly from the cartridge body 64. The distal end can thus be adapted to engage the detonator bore 27 prior to the cartridge body 64 contacting the mounting unit 26.

Moreover, the top mounting unit 26 is adapted to have a portion of the detonation cord 35 secured therein. As such, by positioning the cartridge in a predetermined location within the cavity and relative to the mounting unit 26, and with the detonator 55 also being in a predetermined position within the cartridge body 64, the position of the detonator 55 relative to the top mounting unit 26 (and thus relative to the detonation cord 35) can be determined and assured, thereby improving reliability and performance during operation of the perforating gun.

In this implementation, the support member 84 includes support arms 86 having a U-shaped supporting surface for holding the detonator 55. In some implementations, the detonator 55 can clip into the support arms 86 to secure its position therein, although other configurations are possible. As seen in FIGS. 10 and 11, the proximal portion of the detonator 55 is held in the support member 84, with the distal portion extending outwardly to engage the mounting unit and the detonation cord 35. The support member 84 can further include a rear support 88 adapted to block axial movement of the detonator 55 in one direction (e.g., toward the inside of the cartridge). More specifically, the proximal end surface of the detonator 55 is adapted to abut against the rear support 88, which blocks movement thereof and thereby positions the detonator 55 in a predetermined position within the cartridge body 64. Is it thus noted that the length of the distal portion of the detonator 55 extending into the detonator bore 27 of the mounting unit 26 can be determined when the cartridge is in position (e.g., relative to the tandem sub and/or the mounting unit).

Figure 12:
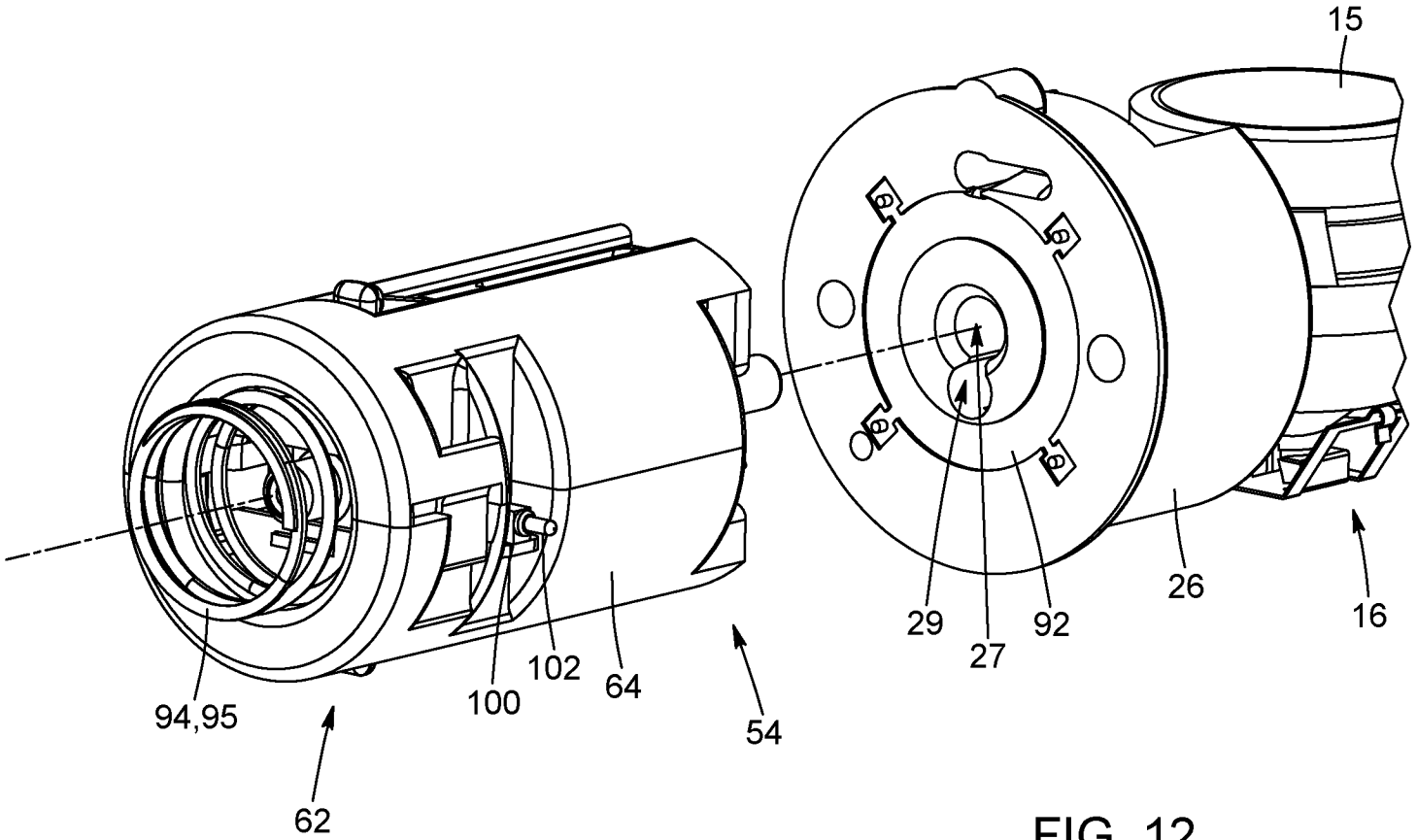
FIG. 12 is an exploded perspective view of the cartridge and the perforating gun subassembly, showing a detonator bore defined in a top mounting unit of the perforating gun subassembly and adapted to receive the detonator, according to an embodiment.
Figure 13:
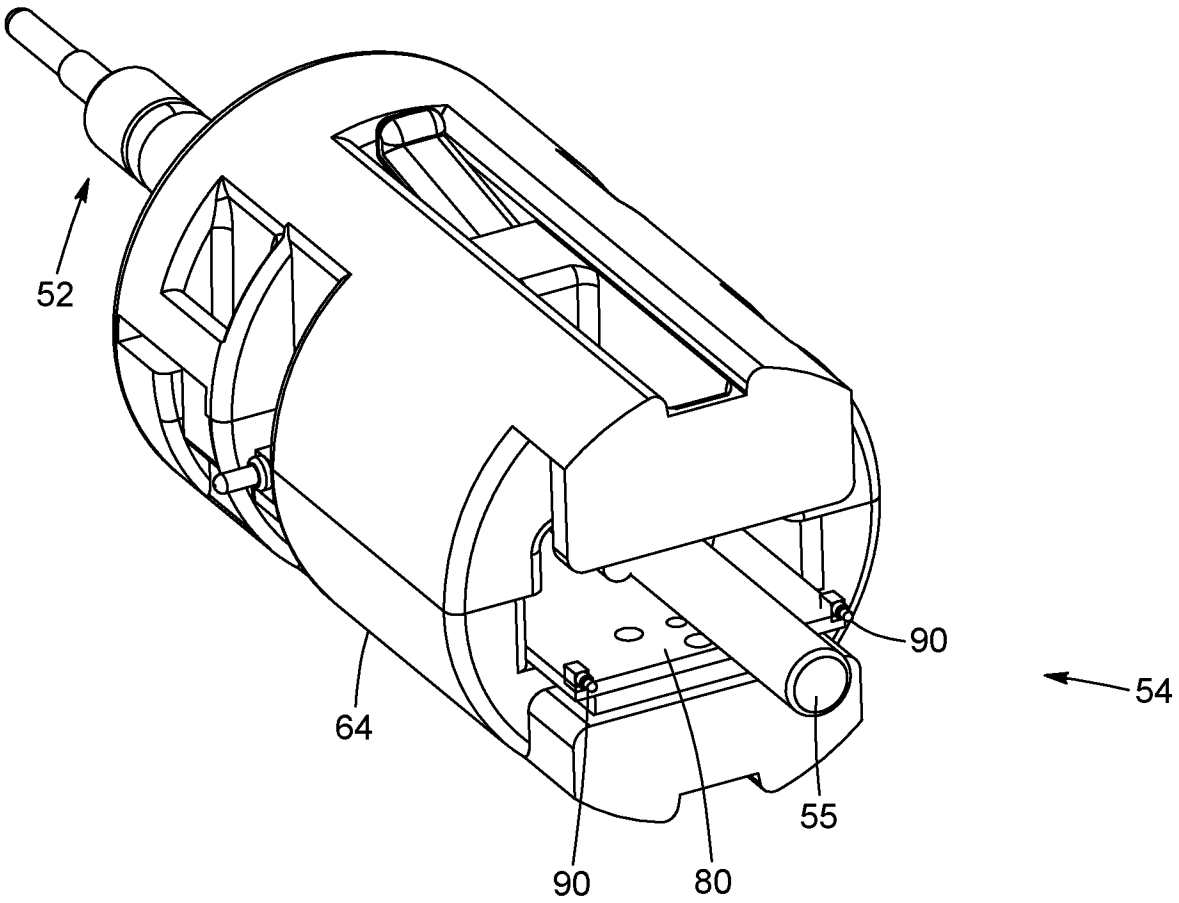
FIG. 13 is a perspective view of the cartridge, showing frontal pins of the PCB assembly for connection with the top mounting unit, according to an embodiment.
Figure 14:
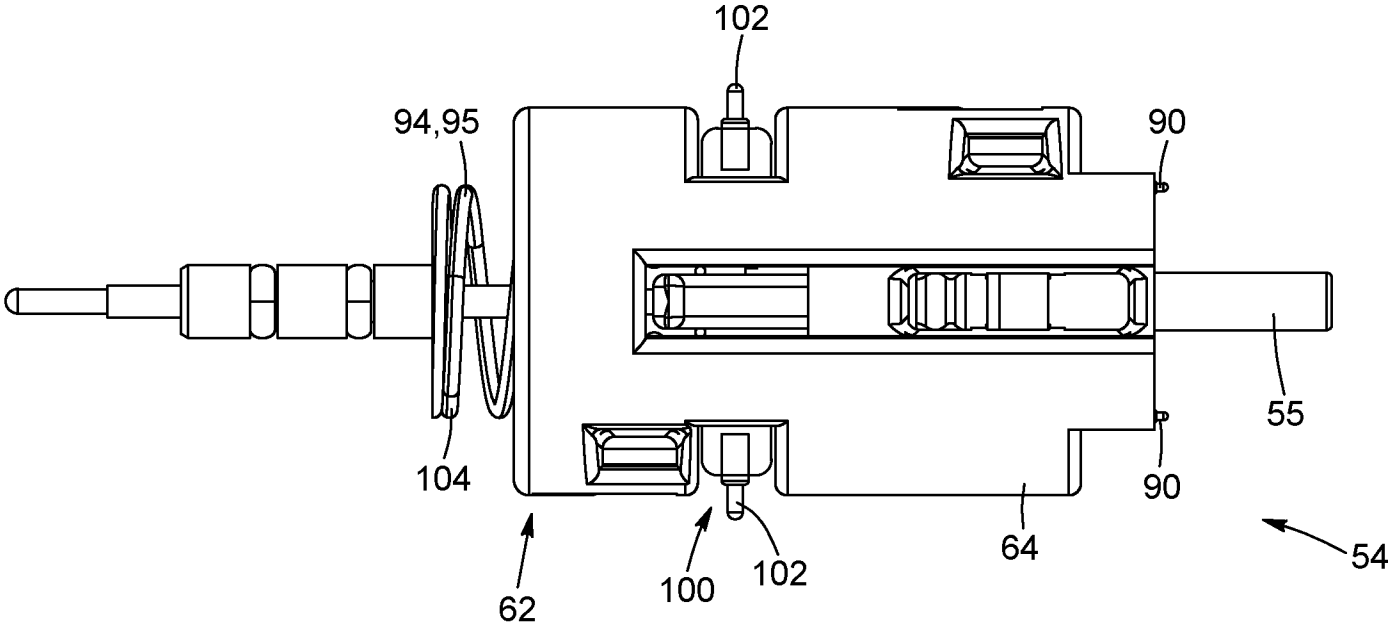
FIG. 14 is a side view of the cartridge shown in FIG. 13, showing a grounding system having grounding pins, according to an embodiment.

With reference to FIGS. 12 to 14, in addition to FIG. 11, the PCB assembly can include a PCB assembly output adapted to operatively engage the mounting unit 26 and establish an electrical connection therebetween. In this implementation, the electrical connection between the PCB assembly and the mounting unit 26 is established through a physical contact between a component of the PCB assembly and a component of the mounting unit. Therefore, the output connection can be indicative of the position of the PCB assembly relative to the mounting unit, which can be indicative of the position of the detonator (e.g., the distal portion thereof) relative to the detonation cord 35.

In some implementations, the PCB assembly 54 includes frontal pins 90 operatively connected to the PCB 80 and extending generally parallel to the detonator 55 and away from the cartridge 62 (e.g., in the downhole direction). The frontal pins 90 can be adapted to relay the electrical signal to the mounting unit via an electrical connection therewith. In some implementations, the top mounting unit 26 can be provided with an electrically conductive portion against which the frontal pins 90 are adapted to abut when the perforating gun is assembled, although other configurations are possible. For example, the top mounting unit 26 can include a brass ring 92 positioned on an uphole face thereof and being shaped and sized to enable engagement with the frontal pins 90. It should thus be appreciated that the cartridge can rotate within the cavity (e.g., with the protrusions sliding along the recess) and the frontal pins 90 remain in contact with the brass ring 92 which extends 360 degrees on the uphole face of the mounting unit. The electrical connection between the frontal pins 90 and the brass ring 92 can be detected or monitored such that the positions of the cartridge and the detonator relative to the mounting unit and the detonation cord can be accurately determined.

The PCB assembly 54 can include a biasing element 94 configured to bias the cartridge downhole in order to urge the frontal pins 90 against the brass ring 92. In this implementation, the biasing element 94 includes a spring 95 coupled to the cartridge and extending between the cartridge and an axial surface of the cavity. As previously mentioned, the spring 95 can also be adapted to protect the cartridge by absorbing at least some of the forces (e.g., from the detonation) and revert the cartridge body 64 back in its initial position (e.g., abutting against the mounting unit) following movement thereof within the cavity. It should thus be noted that the electrical connection system and the tandem sub facilitate connection (both structural and electrical) between the various components of the perforating gun. As described above, the electrical connection system provides a robust electrical connection from the electric connections of the top sub 22 to the detonator 55.

Referring more specifically to FIGS. 11 and 12, the detonation cord 35 is secured within the top mounting unit 26 at a first end thereof in order to have a portion thereof communicating with the detonator 55. In this implementation, the detonation cord 35 includes a head cap 37 configured to be secured to the end of the detonator cord 35, and positioned within a chamber 29 of the mounting unit 26. The chamber 29 can open on an uphole face of the mounting unit 26 (e.g., the same face on which the detonator bore 27 is defined, as seen in FIG. 12). The chamber 29 can have an outlet 29*a* communicating with a downhole side of the mounting unit 26. The head cap 37 is adapted to be positioned within the chamber 29, with the detonation cord extending therefrom and through the chamber outlet to enable the detonation cord 35 to extend along the shaped charge holding system 16 and be connected to each shaped charge 15.

In this implementation, the chamber outlet 29*a* communicates with the detonator bore 27 such that the portion of the detonation cord 35 extending through the chamber outlet 29*a* is adjacent to the detonator 55, as seen in FIG. 11. It is noted that this configuration corresponds to a side transfer mechanism for operating the detonation cord, but that other configurations are possible and may be used. The chamber 29 is shaped and sized to house the head cap 37, and includes a shoulder 31 corresponding to a transition from the chamber to the chamber outlet 29*a*. In other words, the cross-sectional area of the chamber outlet 29*a* is smaller than the cross-sectional area of the chamber 29 such that the shoulder 31 is defined therebetween. The head cap 37 is adapted to abut against the shoulder 31, thereby preventing the detonation cord 35 from disconnecting from the mounting unit 26. It is noted that having the head cap 37 abut the shoulder 31 helps ensure that the detonation cord 35 has an exposed portion extending through the chamber outlet 29*a* to be in communication with the detonator bore 27 and thus the detonator 55.

In some implementations, the PCB assembly 54 further includes a grounding system 100 defining one or more ground paths for the various electrical connections of the electrical connection system. It should be understood that the grounding system 100 is configured to ensure electrical communication to and through the PCB assembly, e.g., ensure electrical connection with the switch and the detonator. In this implementation, the grounding system 100 is adapted to define a plurality of independent ground paths between the PCB assembly 54 and the tandem sub. The grounding system 100 can include one or more grounding pins 102 coupled to the PCB assembly 54 and extending therefrom to engage a grounding surface, such as the tandem sub, for example. It is appreciated that the tandem sub can be at least partially made of a metallic material in order to define the grounding surface for the grounding pins 102.

Still referring to FIGS. 12 to 14, the grounding system 100 can include a pair of grounding pins 102 connected to the PCB 80 and extending therefrom and away from the cartridge 62 (e.g., radially outwardly). The grounding pins 102 extend opposite one another and are shaped and sized to enable engagement with the inner surface of the cavity 38. However, it is appreciated that any suitable number of grounding pins 102 can be used, and that they can extend from the PCB assembly 54 in any other configuration. The grounding pins 102 are independent from one another, and thereby define independent grounding paths. As such, if one grounding pin 102 malfunctions (e.g., breaks and/or is no longer adapted to contact the tandem sub), then the other grounding pin 102 can still provide the required grounding path. In some implementations, the grounding pins 102 include pogo pins having a spring-loaded retractable head which can facilitate engagement of the cartridge within the cavity 38, and engagement of the pins with the grounding surface.

In this implementation, the grounding system 100 includes a secondary grounding component 104 defining a tertiary grounding path (i.e., the grounding pins 102 defining the primary and secondary grounding paths). More specifically, the spring 95 extending between the cartridge body 64 and the tandem sub can be made of a metallic material, and can therefor be adapted to conduct electricity therebetween. The tertiary grounding path is independent from the grounding paths defined by the grounding pins 102, and can thus serve as increased security to have a grounding path between the PCB assembly and the tandem sub. It is therefore noted that the PCB assembly includes components adapted to protect the electric components; the cylindrical plastic housing and the grounding system 100 protect the electrical components from mechanical- and electrical-based complications, such as the forces created from detonating the detonation cord, by providing a bearing surface to take the brunt of the shock (e.g., the pogo pins on the downhole side, and the spring on the uphole side), and by providing grounding paths to protect the electrical components.

In some implementations, various components of the perforating gun 10 are generally tubular. For example, the top sub, the central portion, the bottom sub, the tandem sub, the cartridge, the mounting units of the shaped charge holding system, the plunger assembly and the bulkhead assembly, among others, each have a generally tubular or cylindrical shape. Therefore, it is noted that these components can each include a longitudinal axis which can extend parallel to a centerline (C) of the perforating gun (seen in FIG. 3). In this implementation, the tubular components of the perforating gun 10 can have substantially concentric configurations. In other words, a plurality of the components of the perforating gun each share the same centerline and/or extend along the centerline (C). For example, and as seen in FIGS. 3, 7 and 8, the plunger assembly 42 is installed within the bore 44 of the top sub 22, which is aligned with the centerline (C). Moreover, the bore 40 of the sub body 36 is similarly aligned with the centerline (C) such that the bulkhead assembly 52 (secured within the bore 40) is also aligned therewith. It is appreciated that this configuration facilitates engagement of the bulkhead assembly 52 with the plunger assembly 44, where the connection pin 58 is aligned with the second plunger 45.

With reference to FIGS. 7 to 9, in this implementation, the connection bore 65 of the cartridge body 64 is aligned with the centerline (C), which facilitates engagement of the connection pin 58 (e.g., of the pin head 60) therewith. It is noted that the cartridge body 64 is substantially cylindrical and also includes a longitudinal axis superposed with the centerline (C). On the opposite side of the cartridge body 64 (i.e., the downhole side in the example implementation), the support member 84 (seen in FIG. 10) is shaped and configured to hold the detonator 55 such that it extends along the centerline (C). In FIG. 11, it is noted that the detonator bore 27 is similarly aligned with the centerline to facilitate engagement of the detonator 55 therein. It should therefore be understood that the components of the perforating gun are adapted to define and facilitate robust electrical connections, in addition to robust mechanical connections via the alignment of the various components relative to one another. As used herein, it should be noted that the expression "robust connection" can refer to connections between components which are adapted (e.g., located, positioned and/or are cooperating) to prevent disconnection therebetween at least in downhole operating conditions.

Referring back to FIG. 3, it is noted that the perforating gun 10 can be provided with a downhole tandem sub 34 coupled between the central portion 20 and the bottom sub 24 (and also between the bottom mounting unit 28 and the bottom sub 24). It is noted that the bulkhead assembly 52 of the downhole tandem sub is configured to be electrically connected to the bottom mounting unit 28. In this implementation, the bottom mounting unit 28 has an electrical bore aligned with the centerline (C) for receiving the connection pin of the bulkhead assembly therein. The downhole tandem sub, and corresponding electric connection system housed therein, are adapted to enable operatively connecting shaped charge holding assemblies together and improve modularity of the perforating gun. The shaped charge holding assembly 16 is adapted to relay the electric signal used to operate the detonator from the top mounting unit 26 to the bottom mounting unit 28. As such, the bulkhead assembly from the downhole tandem sub is similarly adapted to relay the electric signal to the output of the PCB assembly housed within the tandem sub.

It is therefore noted that any given perforating gun can include any suitable number of shaped charges. For example, the perforating gun can include a single gun subassembly (e.g., a single shaped charge holding assembly), which can include one or more shaped charges (e.g., extending up to 20 feet long) operatively connected to the tandem sub which houses the switch. Alternatively, the perforating gun can include a plurality of gun subassemblies, where the gun subassemblies is connected to respective tandem subs and switches. It is appreciated that the perforating gun can include as many switches as gun subassemblies, such that each switch is configured to operate a corresponding one of the gun subassemblies.

It should be appreciated from the present disclosure that the various implementations of the perforating gun and related components provide robust connections between the components to prevent failures or malfunctions due to the harsh conditions to which the perforating gun is exposed. The structural elements of the perforating gun (e.g., the housing and the tandem subs) are shaped and adapted to be connected to one another in a manner enabling alignment of the components housed therein, while also facilitating electrical connection between these components. For instance, the plunger assembly, the bulkhead assembly, the cartridge, the detonator and the shaped charge holding assembly are each aligned with one another along the perforating gun. Moreover, the solid bulkhead assembly secured within the tandem sub is configured to remain engaged with the cartridge, which is slidably mounted to the connection pin of the bulkhead. As such, the cartridge can axially move within the tandem sub (e.g., in response to forces applied thereto following a detonation) but is positioned to remain electrically coupled to the bulkhead assembly.

In some implementations, the gun carrier (e.g., the central portion) can be moved relative to the tandem subs without hindering the electrical connection through the perforating gun. As such, the gun subassembly, and more specifically, the shaped charges can be reoriented (e.g., after the perforating gun is assembled) to a desired or preferred orientation. In this implementation, the central portion can be spaced from the top tandem sub (e.g., axially moved in the downhole direction) but maintains a section thereof (of the central portion) overlapping seals coupled between the tandem sub and the central portion, thereby maintaining the mechanical connection and pressure isolation. Additionally, when moving the central portion in the downhole direction, the spring of the PCB assembly remains adapted to bias the cartridge downhole to maintain the electrical connection with the top mounting unit. It should be understood that moving the cartridge in the downhole direction is enabled by the sliding connection of the cartridge with the bulkhead assembly, and that the bulkhead assembly is sized to remain in electrical connection with the cartridge as it is moved downhole. It is noted that the sliding connection can make up the tolerance stackup depending on the male pin design.

The cartridge further provides the grounding paths adapted to prevent malfunction of the PCB assembly, among other components. The grounding paths are independent from one another such that the ground communication is more reliable, for example, if one the grounding elements no longer contacts the grounding surface. The spring of the cartridge can be multipurpose, where it can bias the cartridge downhole to abut and electrically connect to the mounting unit, it can create one of the independent grounding paths by contacting an inner surface of the tandem sub, and it can absorb some of the forces created from operating the perforating gun to protect the components within the cartridge.

In addition, the support member of the cartridge is adapted to maintain the detonator centered and aligned with the mounting unit which houses the detonation cord, and further defines a backstop to the detonator such that the distal end extends out of the cartridge by a known distance. The head cap of the detonation cord, combined with the spring of the cartridge biasing the cartridge against the mounting unit, further enhances reliability of the ballistic transfer between the detonator and the detonation cord. More specifically, the position of the detonator output charge within the mounting unit is known when electrical connection is established between the cartridge and the mounting unit. Therefore, the position of the detonator relative to the exposed portion of the detonation cord can also be known, thereby providing for a reliable transfer of energy.

The described example implementations are to be considered as being only illustrative and not restrictive. The present disclosure intends to cover and embrace all suitable changes in technology. The scope of the present disclosure is, therefore, described by the appended claims rather than by the foregoing description. The scope of the claims should not be limited by the implementations set forth in the examples but should be given the broadest interpretation consistent with the description as a whole.

As used herein, the terms "coupled", "coupling", "attached", "connected" or variants thereof as used herein can have several different meanings depending in the context in which these terms are used. For example, the terms coupled, coupling, connected or attached can have a mechanical and/or electrical connotation. For example, as used herein, the terms coupled, coupling or attached can indicate that two elements or devices are directly connected to one another or connected to one another through one or more intermediate elements or devices via a mechanical element depending on the particular context.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the perforating gun as shown may consist of certain geometrical configurations as explained and illustrated herein, not all of these components and geometries are essential and thus should not be taken in their restrictive sense, i.e., should not be taken as to limit the scope of the present disclosure. It is to be understood that other suitable components and cooperations thereinbetween, as well as other suitable geometrical configurations may be used for the implementation and use of the perforating gun, and corresponding parts, as briefly explained and as can be easily inferred herefrom, without departing from the scope of the disclosure.

The invention claimed is:

1. A perforating gun for deployment in a wellbore extending within an underground reservoir, comprising:

a gun housing comprising a gun carrier;

a shaped charge holding assembly installed within the gun carrier and comprising one or more shaped charge holders configured to receive and support respective shaped charges;

a tandem sub operatively coupled to the gun carrier and having a sub body having a bore defined therethrough;

an electrical connection system, comprising:

a bulkhead assembly located within the tandem sub and comprising a bulkhead electrical connector securable within the bore of the sub body;

a printed circuit board (PCB) assembly, comprising:

a cartridge comprising a cartridge body having a connection bore defining a PCB assembly input adapted to receive the bulkhead electrical connector and define a sliding connection between the cartridge and the bulkhead assembly;

an addressable switch located within the cartridge body, the addressable switch being adapted to be in electrical communication with the bulkhead electrical connector via the PCB assembly input;

a detonator located within the cartridge body and in electrical communication with the addressable switch, the cartridge body having a support member for holding the detonator in a predetermined position, the shaped charge holding assembly being adapted to engage the detonator to enable ballistic transfer to a detonation cord connected to the shaped charge holding assembly.

2. The perforating gun of claim 1, wherein the sub body includes a cavity defined therein, the cavity being shaped and sized to house the cartridge, and wherein the bore communicates with the cavity such that the bulkhead electrical connector extends within the cavity for engaging the connection bore of the cartridge body.

3. The perforating gun of claim 1, wherein the shaped charge holding assembly comprises a mounting unit coupled to an outer shaped charge, the mounting unit having a detonator bore and a chamber in communication with one another, and wherein the detonator is adapted to engage the detonator bore and the detonation cord includes an exposed portion adapted to extend though the chamber to facilitate ballistic transfer from the detonator to the detonation cord.

4. The perforating gun of claim 3, wherein the outer shaped charge is one of an upholemost shaped charge and a downholemost shaped charge.

5. The perforating gun of claim 4, wherein the mounting unit comprises a top mounting unit coupled to the upholemost shaped charge, and further comprises a bottom mounting unit coupled to the downholemost shaped charge.

6. The perforating gun of claim 1, wherein the cartridge body is slidably connectable to the bulkhead electrical connector of the bulkhead assembly.

7. The perforating gun of claim 1, wherein the PCB assembly further comprises a grounding system defining a plurality of independent ground paths between the PCB assembly and the tandem sub.

8. The perforating gun of claim 7, wherein the grounding system comprises two or more grounding pins coupled to the printed circuit board and extending radially from the cartridge body, the grounding pins being adapted to engage with radial surfaces of the cavity and define respective independent ground paths.

9. The perforating gun of claim 7, wherein the grounding system comprises a secondary grounding component extending between the cartridge and an axial surface of the cavity, the secondary grounding component defining a secondary independent grounding path.

10. The perforating gun of claim 9, wherein the secondary grounding component comprises a resilient component adapted to absorb at least some of forces being applied to the PCB assembly from operating the perforating gun.

11. The perforating gun of claim 9, wherein the secondary grounding component includes a metallic spring.

12. The perforating gun of claim 1, wherein the cartridge is substantially tubular and has a longitudinal axis defining a centerline, and wherein the connection bore and the bulkhead assembly are adapted to be aligned with and extend along the centerline.

13. The perforating gun of claim 12, wherein the support member is adapted to hold the detonator in alignment with the centerline of the cartridge.

14. The perforating gun of claim 13, wherein the support member comprises support arms and a rear support, and the detonator has a proximal portion adapted to clip into the support arms and a proximal end adapted to abut against the rear support to position the detonator in the predetermined position, the detonator further having a distal portion extending further than the cartridge to engage the mounting unit.

15. The perforating gun of claim 14, wherein the PCB assembly further comprises a PCB assembly output comprising frontal pins adapted to operatively engage the mounting unit and establish an output connection therebetween, wherein the output connection is indicative of the position of the cartridge relative to the mounting unit, which is indicative of the position of the distal portion of the detonator relative to the detonation cord.

16. An electrical connection system for providing an electrical signal to a detonator of a perforating gun adapted for deployment in a wellbore extending within an underground reservoir, comprising:

a tandem sub operatively coupled to a gun housing and having a sub body having a bore defined therethrough;

a bulkhead assembly having a bulkhead electrical connector securable within the bore of the sub body and adapted to relay an electrical signal therethrough; and a printed circuit board (PCB) assembly, comprising:

a cartridge comprising a cartridge body having a connection bore defining a PCB assembly input adapted to receive the bulkhead electrical connector and define a sliding connection between the cartridge and the bulkhead assembly, the cartridge having a support member for holding and positioning the detonator in a predetermined position to provide ballistic transfer to a detonation cord connected to shaped charges of the perforating gun;

an addressable switch located within the cartridge body, the addressable switch being adapted to be in electrical communication with the bulkhead electrical connector via the PCB assembly input to relay the electrical signal to the detonator.

17. The electrical connection system of claim 16, wherein the PCB assembly further comprises a biasing element operatively coupled between the tandem sub and the cartridge and being adapted to bias the cartridge toward a shaped charge holding assembly of the perforating gun to maintain engagement of the detonator with the shaped charge holding assembly.

18. An electrical connection system for providing an electrical signal to a detonator of a perforating gun adapted for deployment in a wellbore extending within an underground reservoir, comprising:

a tandem sub operatively coupled to a gun housing and having a sub body having a bore defined therethrough;

a bulkhead assembly having a bulkhead electrical connector securable within the bore of the sub body and being adapted to relay an electrical signal therethrough; and a printed circuit board (PCB) assembly, comprising:

a cartridge comprising a cartridge body having a connection bore defining a PCB assembly input adapted to receive the bulkhead electrical connector and define a sliding connection between the cartridge and the bulkhead assembly;

an addressable switch located within the cartridge body, the addressable switch being adapted to be in electrical communication with the bulkhead electrical connector via the PCB assembly input;

the detonator being located within the cartridge body and in electrical communication with the addressable switch, the cartridge body having a support member for holding the detonator in a predetermined position, each one of the bore, the bulkhead electrical connector, the cartridge and the detonator being concentrically disposed relative to one another and extend along a common axis.

19. The perforating gun of claim 18, wherein the cartridge is substantially tubular and has a longitudinal axis defining a centerline corresponding to the common axis.

20. The perforating gun of claim 18, wherein the support member comprises support arms and a rear support, and the detonator has a proximal portion adapted to clip into the support arms and a proximal end adapted to abut against the rear support to position the detonator in the predetermined position and in alignment with the common axis, the detonator further having a distal portion extending further than the cartridge.

* * * * *